US006348009B1

(12) United States Patent
Dischler

(10) Patent No.: US 6,348,009 B1
(45) Date of Patent: Feb. 19, 2002

(54) ADJUSTABLE GOLF CLUB WITH HYDRODYNAMIC LOCK-UP

(75) Inventor: Louis Dischler, Spartanburg, SC (US)

(73) Assignee: Delphi Oracle Corp., Spartanburg, SC (US)

( * ) Notice: Subject to any disclaimer, the term of this patent is extended or adjusted under 35 U.S.C. 154(b) by 42 days.

(21) Appl. No.: 09/619,432

(22) Filed: Jul. 19, 2000

(51) Int. Cl.[7] ..... A63B 53/06
(52) U.S. Cl. ..... 473/247; 473/326
(58) Field of Search ..... 473/244, 245, 473/246, 247, 248, 326

(56) References Cited

U.S. PATENT DOCUMENTS

| | | | | |
|---|---|---|---|---|
| 1,219,417 | A | | 3/1917 | Vories |
| 1,429,569 | A | | 9/1922 | Craig |
| 2,305,270 | A | | 12/1942 | Nilson |
| 2,571,970 | A | | 10/1951 | Verderber |
| 2,882,053 | A | | 4/1959 | Lorthiois |
| 2,962,286 | A | * | 11/1960 | Brouwer |
| 3,601,399 | A | | 8/1971 | Agens et al. |
| 3,840,231 | A | | 10/1974 | Moore |
| 4,287,250 | A | | 9/1981 | Rudy |
| 4,878,666 | A | | 11/1989 | Hosoda |
| 5,133,553 | A | | 7/1992 | Divnick |
| 5,538,245 | A | | 7/1996 | Moore |

* cited by examiner

*Primary Examiner*—Stephen Blau

(57) ABSTRACT

The various embodiments of the invention are directed to a golf club head having an adjustable loft, wherein the loft angle is hydrodynamically locked during impact of the club head with the ball.

32 Claims, 4 Drawing Sheets

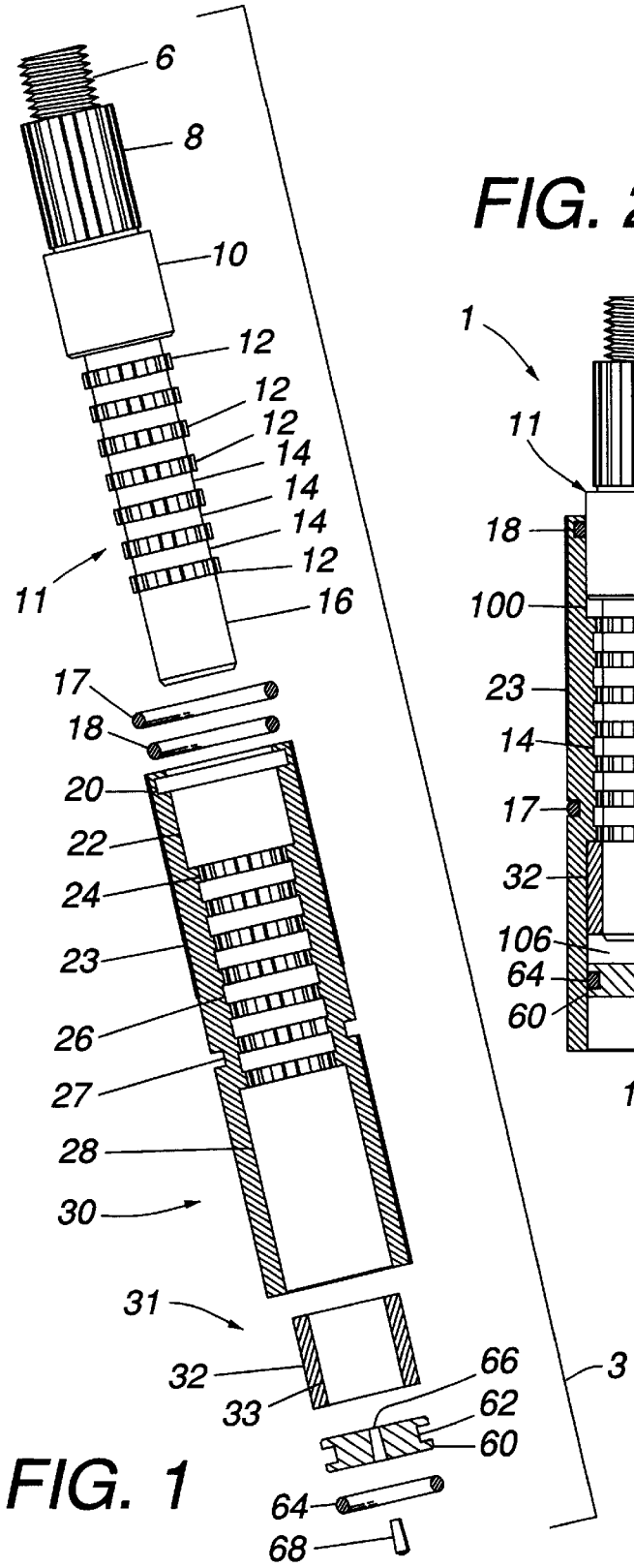
FIG. 1
FIG. 2A
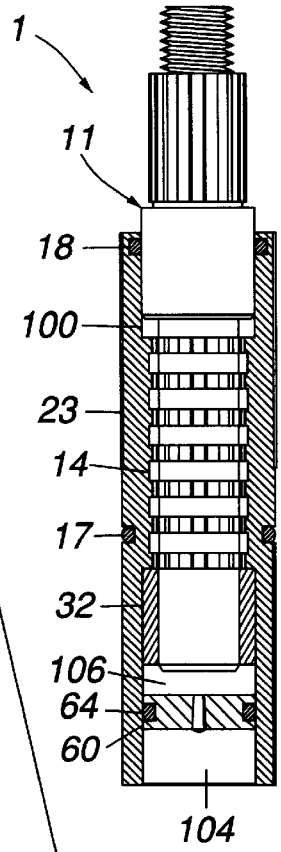
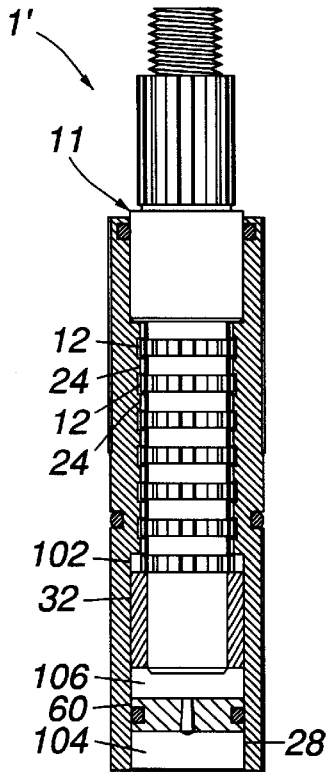
FIG. 2B

FIG. 3
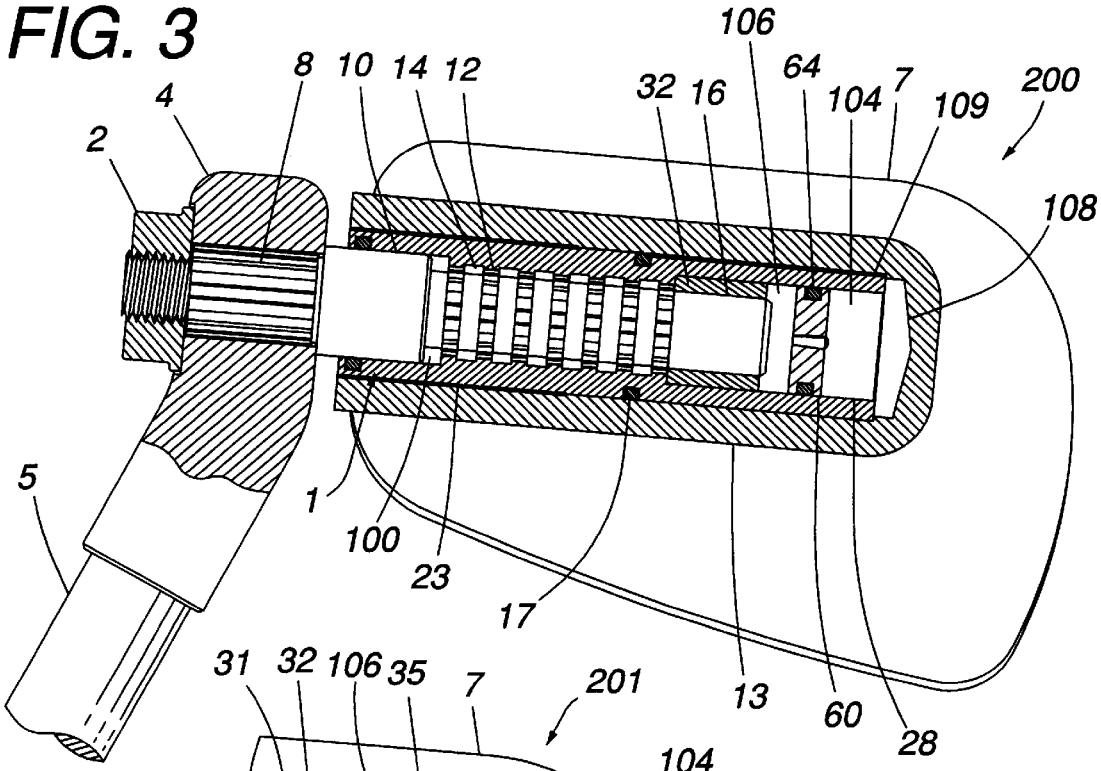
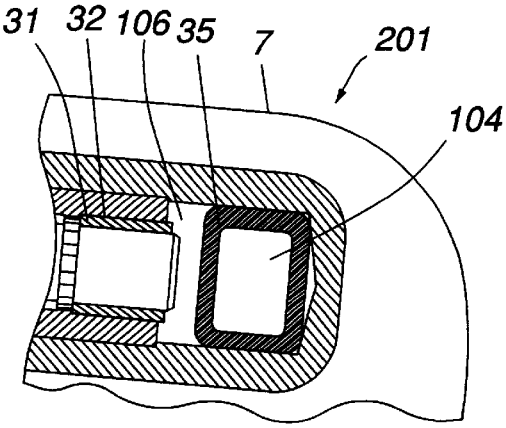
FIG. 4A
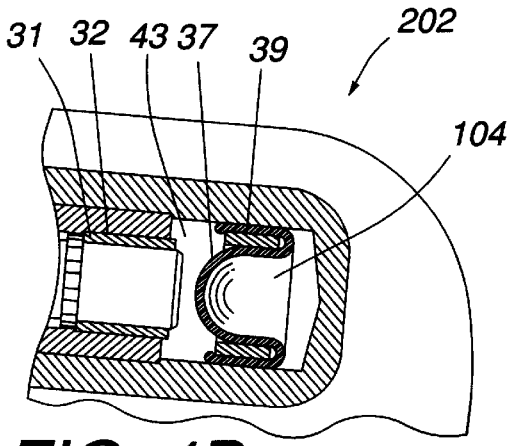
FIG. 4B
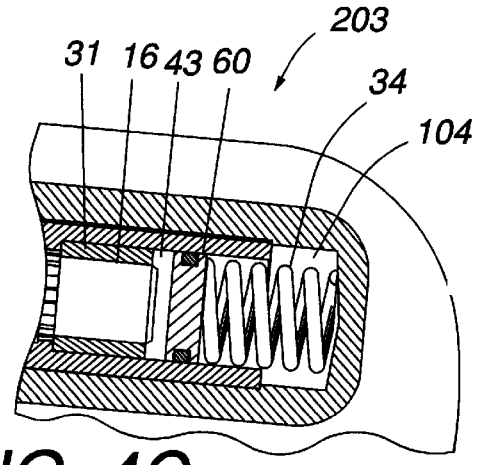
FIG. 4C

FIG. 5
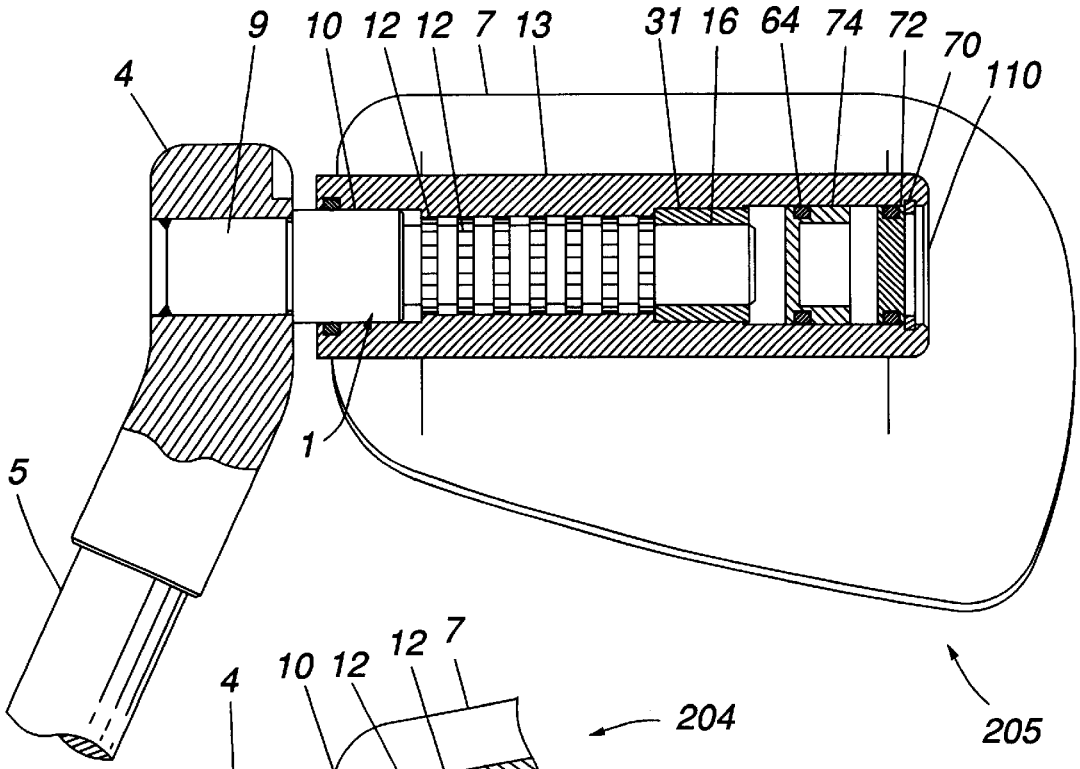
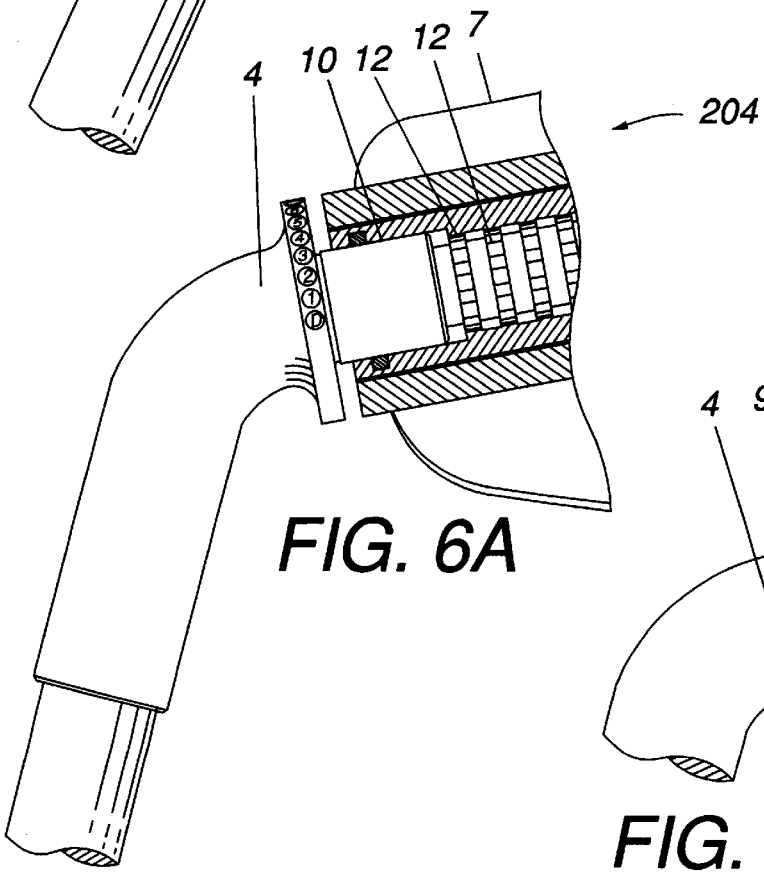
FIG. 6A
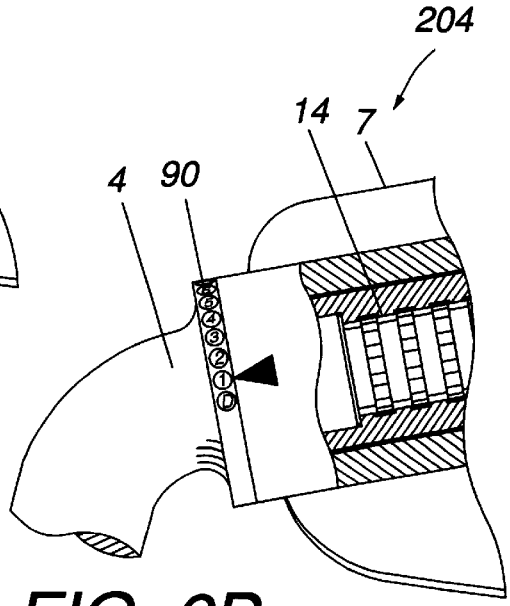
FIG. 6B

ADJUSTABLE GOLF CLUB WITH HYDRODYNAMIC LOCK-UP

FIELD OF THE INVENTION

The present invention relates to golf clubs, and more particularly relates to a golf club head having an adjustable loft.

BACKGROUND OF THE INVENTION

In golf, clubs are used having varying loft angles to impart greater or lesser distance or height to the ball. Drivers having a slight angle from the vertical are used to drive the ball a great distance horizontally with a relatively flat trajectory. A putter with virtually no loft angle is used on the green itself. At intermediate distances, irons having varying loft angles measured from the vertical are used. Typically, larger loft angles are used for shorter distances. Most golfers use up to 14 clubs (limited by rule) with varying lofts at approximately four-degree increments. The need for multiple clubs creates a number of disadvantages, such as the high cost of a complete or partial set, and the need for transportation of a bulky and heavy set of clubs, both to and on the course.

A number of adjustable golf clubs have been developed with the object of reducing the number of clubs required. Many designs have used one or more sets of teeth or splines to key-in the various desired loft angles. Adjustable club heads using splined shafts are exemplified by U.S. Pat. Nos. 1,219,417 to Vories; 2,305,270 to Nilson; 1,429,569 to Craig; 2,571,970 to Verderber; 3,601,399 to Agens et al; and 4,878,666 to Hosoda. Clubs employing multiple toothed rings for vernier adjustment are exemplified by U.S. Pat. Nos. 2,882,053 to Lorthiois; and 3,840,231 and 5,538,245, both to Moore. A ratcheting vernier adjustment is taught in U.S. Pat. No. 5,133,553 to Divnick. Sealed containers having permeable elastomeric sheets sealed together and inflated with a gas having low permeability therethrough is taught in U.S. Pat. No. 4,287,250, to Rudy. The teachings of the patents cited above are entirely incorporated herein by reference.

As the impact of the club head with the ball generates large forces and torques acting in unpredictable directions, various auxiliary fastening devices such as nuts, screws and levers have been used to lock-up the head so that the loft angle does not accidentally change during use. These auxiliary devices are undesirable, as they detract from the enjoyment of the game. They are also prone to failure with repeated use, due to over or under tightening, and to contamination or corrosion.

It would be desirable for a club to be self-locking, so that no auxiliary devices would be needed. It would also be desirable that the concentration of the golfer not be broken by the need to make complicated adjustments to the club. And it would be most desirable that the loft angle be changeable in one continuous and smooth motion by the golfer.

SUMMARY OF THE INVENTION

The present invention provides a uniquely simple solution to the problems associated with adjustable golf clubs, and does so without requiring that the golfer remember arcane and complicated adjustment procedures. Rather, the instant invention provides a perfectly natural and aesthetically desirable look and feel for both the club and the adjustment thereof, while also enhancing the technical performance of the club.

An important feature of an adjustable club is that the loft angle, once set, does not change during use. First of all, if the equipment is not reliable, the player's lack of confidence can negatively effect his game, and secondly, a club head that moves under impact conditions can damage the adjustment mechanism, and ruin the club. In the present invention, the head, once set at the desired loft angle, is hydrodynamicly locked-up, and cannot move into an unlocked position due to the collision of the club with a ball. This lock-up is achieved automatically during impact conditions.

As golf is an aesthetic game, it is important that the head adjusts smoothly, substantially without noise or snap-back, and without requiring tools. It is also important that the adjustment is easily achieved without the need for calculation on the part of the golfer.

The present invention accomplishes the above and other objectives by dividing the working volume within the adjustable club head into at least three chambers: first and second chambers filled with an incompressible fluid, and a third chamber filled with a compressible fluid.

The working volume within the club head comprises a splined (toothed) pivot shaft which mates with a splined inner cylinder surface fixed within the adjustable club head. It is desirable that both the exterior splined surface of the pivot shaft and the interior splined surface of the cylinder are segmented, with gaps therebetween, so as to reduce the total axial motion required to de-couple the splines while providing sufficient tooth area to resist rotation. When not being adjusted, the splines are aligned so as to prevent relative rotation, and the pressure of the gaseous fluid within the third chamber maintains this coupled axial alignment. The third chamber pressurizes the second liquid filled chambers by means of a flexible diaphragm or floating piston therebetween. The first chamber is pressurized by means of a fluid conduit between the first and second chambers, so that, at rest, the pressures in all three chambers are equal (and above atmospheric). Most typically, all chambers are coaxial with the pivot shaft, with the second chamber between the first and third chambers.

The conduit between the first and second chambers restricts the rate of fluid flow between them. This results in a small pressure build-up within the first chamber relative to the second, resulting in a resistance and a smooth axial motion of the club head on the pivot shaft as the two are pressed together by the golfer during adjustment. During a stroke, while under impact conditions, the pressure build-up is much greater than it is during adjustment, and tends to resist axial motion and the resultant de-coupling of the splines. By way of example only, and not limitation, if one pound of force applied for one second is necessary to de-couple the splines during adjustment (this is the hydrodynamic force generated by fluid flow in the conduit only, and neglects the gas pressure in the third chamber, which must also be overcome), then, during an impact of the golf head with a ball lasting only one millisecond, a million pounds of force would be required to move the fluid through the conduit and thereby de-couple the splines. The force required is so much greater because the hydraulic force generated varies inversely with the square of the time period involved. If the impact period is three orders of magnitude smaller than the adjustment period, then the de-coupling force required will be six orders of magnitude greater. This force resisting de-coupling is so large that the head remains effectively locked-up during the brief period of impact.

BRIEF DESCRIPTION OF THE DRAWINGS

The above as well as other objects of the invention will become more apparent from the following detailed description of the preferred embodiments of the invention, when taken together with the accompanying drawings in which:

FIG. 1 is a cross-sectional exploded view of a pivot cartridge showing the various elements of one embodiment of the invention.

FIG. 2A is a cross-sectional view of an assembled pivot cartridge according to an embodiment of the invention, with the cartridge in the distal or engaged position.

FIG. 2B is a cross-sectional view of an assembled pivot cartridge as in FIG. 2A, with the cartridge in the proximal or disengaged position.

FIG. 3 is a cross-sectional view of an assembled adjustable head comprising a pivot cartridge according to a preferred embodiment of the invention, with the head in the distal position.

FIG. 4A is a partial cross-sectional view of an assembled adjustable head according to an alternative embodiment of the invention, wherein a fluid cell is substituted for the piston of FIG. 3.

FIG. 4B is a partial cross-sectional view of an assembled adjustable head according to an alternative embodiment of the invention, wherein a diaphragm is substituted for the fluid cell of FIG. 4A.

FIG. 4C is a partial cross-sectional view of an assembled adjustable head according to an alternative embodiment of the invention, wherein a spring is substituted for or supplements the compressed fluid of FIG. 3.

FIG. 5 is a cross-sectional view of an assembled adjustable head according to an embodiment of the invention.

FIG. 6A is a partial cross-sectional view of an assembled adjustable head according to another embodiment of the invention, shown in the distal orientation, and wherein the hosel is integrated into the pivot shaft.

FIG. 6B is a partial cross-sectional view of the assembled adjustable head of FIG. 6A, shown in the proximal orientation.

DESCRIPTION OF THE INVENTION

Figure 7:
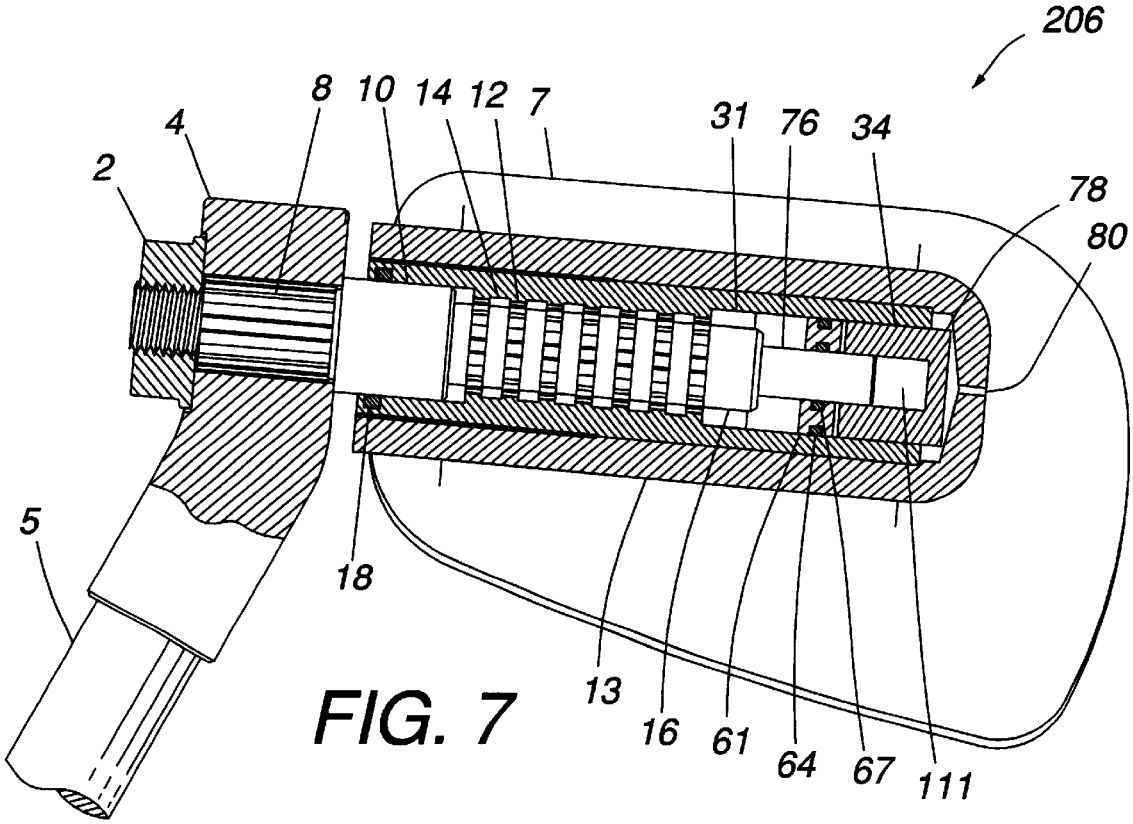
FIG. 7 is a cross-sectional view of an assembled adjustable head according to another embodiment of the invention, with the head in the distal position.

An exploded view of a pivot cartridge for insertion into an adjustable club head according to a preferred embodiment of the instant invention is shown generally as numeral 3 in FIG. 1, and the assembled pivot cartridge is shown in the engaged (distal) position generally as numeral 1 in FIG. 2A and in the disengaged (proximal) position generally as numeral 1' in FIG. 2B. Referring now to FIGS. 1, 2A, 2B, the pivot shaft 11, comprises a bearing surface 10 and a shaft extension 16. A plurality of exterior spline (toothed) segments 12 are spaced apart by exterior gap segments 14. A splined shaft 8 and threaded shaft extension 6 are provided for attachment with a hosel (not shown). The pivot shaft 11 mates with cylinder 30, comprising a bearing surface 22, having a diameter slightly larger than the diameter of the bearing surface 10 of the pivot shaft 11. Interior spline segments 24 engage exterior spline segments 12 when in the engaged position illustrated in FIG. 2A. A bushing 31 has a bushing ID 33 for press fitting or otherwise attaching to shaft extension 16, and a bushing OD 32, slightly smaller than the diameter of the bearing surface 28 of the cylinder 30, so that it may freely rotate and slide therein. A seal 18 fits into groove 20 of cylinder 30, and prevents fluid leakage from between the mating bearing surfaces 22, 10. Piston 60 having seal 64 fitting into groove 62 floats in bearing surface 28. Tapered hole 66 is plugged by tapered pin 68. Seal 17 fits in the groove 27 of the exterior surface of the cylinder 30.

In FIG. 2A, chamber 100 constitutes the first chamber, which is filled with a substantially incompressible fluid. This incompressible fluid may be any liquid or gel; but oil or grease are preferred, due to the lubricating action and prevention of corrosion of the internal components of the cartridge. In FIG. 2A, the pivot cartridge 1 is in the engaged (distal) position, while the pivot cartridge 1', shown in FIG. 2B, is in the disengaged (proximal) position. ("Distal" and "proximal" refer to the relative position of the club head with inserted pivot cartridge, to the hosel.) In FIG. 2B, fluid has been driven from the chamber 100 of FIG. 2A through the engaged interior and exterior spline segments 24, 12, which together constitute a restricted conduit, to chamber 102. If the bushing OD 32 is larger or equal to the diameter of the bearing surface 10, chamber 102 constitutes the second chamber. If the bushing OD 32 is smaller than the diameter of the bearing surface 10, then fluid is also forced between the mating surfaces of the bushing OD 32 and the bearing surface 28 (a restricted conduit in series with the engaged interior and exterior spline segments) into chamber 106, which then constitutes the second chamber. In moving between the distal to the proximal positions, the fluid pressure in the first chamber increases by an amount which is generally proportional to the square of the rate of movement, and this increased pressure acts to resist the motion of the pivot shaft 11 relative to the cylinder 30. The primary purpose of chamber 106 is to provide volumetric compliance for the changing volume of the first chamber during motion. The first and second chambers and restricted conduit(s), i.e., the volume bounded by seals 18, 64, may be filled with an incompressible fluid by immersing the assembled cartridge 1 (sans piston 60) in the fluid and drawing and releasing a vacuum. The piston 60 may then be inserted so that air escapes through tapered hole 66, which is then sealed with tapered pin 68. Other means such as screws may be used to seal the hole 66, and the piston 60 may be also be installed under vacuum so that no hole is necessary.

Turning now to FIG. 3, the club head, generally indicated by numeral 200, comprises the pivot cartridge 1, shown inserted in the engaged or distal position into the club support 13, which supports club face 7. The pivot cartridge 1 is shown mounted to hosel 4 by means of nut 2. Hosel 4 is the interface to handle shaft 5, by which the club is gripped and swung. Chamber 104, formed by the piston 60, the bearing surface 28 and the blind hole 108, is filled with a compressible fluid, preferably a gas or gas and liquid and/or gel mixture. This compressible fluid may be compressed and trapped during the installation of the pivot cartridge 1, as it is preferably press-fit into the blind hole 108. The compression of this fluid may be regulated by the position of the seal 17 along the cylinder 30, with excess fluid vented by means of groove 109 until the seal 17 makes contact with the open end of the blind hole 108, at which point further leakage is prevented. Knurled surface 23 is provided on the exterior of cylinder 30 to prevent rotation of the cylinder 30 within the blind hole 108. A heavy press fit, adhesives, pins, keys or brazing may also be used to prevent rotation. Insertion is facilitated by the prior assembly of the pivot cartridge 1.

Turning now to FIG. 4A, wherein the club head is generally indicated by numeral 201, an alternative configuration of the third chamber containing the compressible fluid is shown as fluid cell 35, which comprises a hollow flexible. Fluid cell 35 may comprise polymeric, elastomeric, rubber or other flexible materials resistant to the incompressible fluid and substantially impermeable to the compressible fluid. The fluid in the fluid cell 35 may be compressed during insertion of the pivot cartridge 1 in the same way as described above with reference to FIG. 3. While the compressible fluid may consist entirely of air, or of gases such as nitrogen, oxygen, argon, methane, ethane, propane, butane, fluoroform, neo-pentane, and others, there are advantages that accrue from using gases having intrinsically low diffusion rates due to large size and symmetrical molecular shape. Use of such gases would be especially valuable when used within a fluid cell comprised of rubber, elastomer, or polymer. Such gases would include perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane; 1,1,2-trichloro-1,2,2 trifluoroethane, chlorotrifluorethylene, bromotrifluoromethane, and monochlorotrifluoromethane, hexafluoroethane, sulfur hexafluoride, perfluoropropane, perfluorobutane and mixtures thereof. If the fluid cell is filled with one of this group, and with a less than atmospheric partial pressure of nitrogen and oxygen (and preferably no nitrogen or oxygen), then any air that might leak into the club head and mix with the incompressible fluid would, over time, tend come into contact with the surface of the fluid cell 35 and would diffuse into the fluid cell, as the fluid cell composition may be altered to allow a slow rate of permeability for the atmospheric gases, while still preventing leakage of the inflatant gas. The fluid cell would thus act as a scavenger to rid the incompressible fluid of undesired compressible fluid, as the compressible fluid would undesirably tend to reduce the bias pressures generated during axial motion. For scavenging of air, the fluid cell inflatant gas should preferably have a permeability relative to the fluid cell of less than 0.1 times that of air, and preferably less than 0.01 times that of air.

In FIG. 4B, wherein the club head is generally indicated by numeral 202, the fluid cell is replaced with a diaphragm 37 held in place with clamp 39, forming the flexible side of chamber 104. In practice, the diaphragm 37 operates in the same manner as the fluid cell 35. Alternatively, a sealed metal bellows may be used, and the chamber would then be completely impermeable.

In FIG. 4C, wherein the club head is generally indicated by numeral 203, the pressure supplied by the compressible fluid in the third chamber is partially or completely replaced by a spring 34, operating on piston 60.

Turning now to FIG. 5, the pivot shaft 11 is attached to hosel 4 by means of a press fit with smooth shaft 9, which may also be welded to the hosel. The pivot shaft 11 is inserted into a through hole 110, into which external spine segments 24 are directly formed. A piston 74 serves with end cap 72 to trap a compressible fluid. Extrusion of the end cap 72 is prevented by snap ring 70. The club head is generally indicated by the number 205.

In FIG. 6A, an alternative construction is shown wherein the hosel 4 is integrated with the pivot shaft. The club head 204 is shown in the distal or engaged position. In FIG. 6B, the club head 204 is shown in the proximal or disengaged position. This proximal position also facilitates the reading the loft angle by way of the indicia 90.

Figure 8:
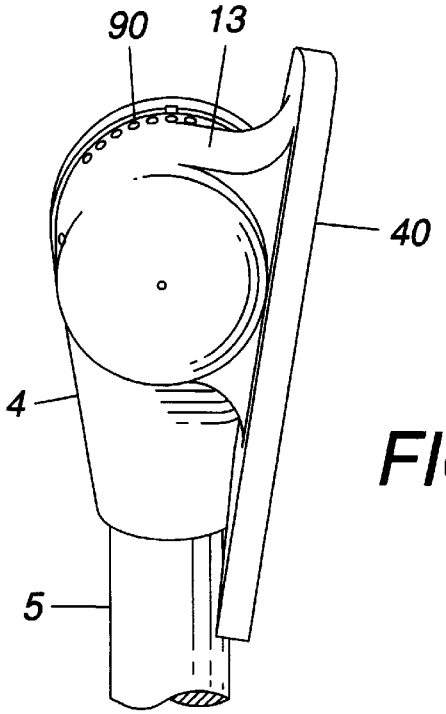
FIG. 8 is a right side view of the adjustable head shown in FIG. 7.

Turing now to FIG. 7, yet another embodiment is shown wherein the chamber 111 acts as the first chamber, and is filled with an incompressible fluid. The motion of the plunger 76 into cup 78 as the club head 206 is moved from the distal to the proximal position drives fluid into the second chamber formed by the gap between piston 61 and cup 78. In this case, the third chamber constitutes the volume between seal 64 and seal 18, and is filled with a compressible fluid, which may comprise a gas, or gas and liquid and/or gel mixture. Hole 80 facilitates the insertion of the pivot cartridge by venting air during insertion. In FIG. 8, the right end view of the embodiment shown in FIG. 7 is illustrated, showing strike surface 40.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

I claim:

1. A club head having an adjustable loft angle, comprising:

a surface for impacting a golf ball;

a pivot shaft mounted in the club head;

toothed means for preventing rotation of the club head about said pivot shaft;

means for axially biasing said club head on said pivot shaft into a rotatably locked position relative to said pivot shaft; and means for generating a hydrodynamic bias pressure, said bias pressure resisting axial movement of said club head relative to said pivot shaft during impact of the club head with said golf ball;

whereby the loft angle of the club head remains unchanged during impact with said golf ball.

2. A club head having an adjustable loft angle as recited in claim 1, wherein said means for generating a hydrodynamic bias pressure comprises a first chamber having a first variable volume, a second chamber having a second variable volume, and a restrictive fluid conduit placing said first chamber in fluid communication with said second chamber; said first chamber, said second chamber and said restrictive fluid conduit all filled with a substantially incompressible fluid, whereby axial motion of the club head on said pivot shaft flows said incompressible fluid between said first chamber and said second chamber.

3. A club head having an adjustable loft angle as recited in claim 2, wherein said axial motion of the club head on said pivot shaft creates a pressure differential between said first chamber and said second chamber, said pressure differential tending to resist said axial motion, and said pressure differential tending to increase as the velocity of said axial motion increases.

4. A club head having an adjustable loft angle as recited in claim 2, said means for axially biasing said club head on said pivot shaft comprising a spring.

5. A club head having an adjustable loft angle as recited in claim 2, said means for axially biasing said club head on said pivot shaft comprising a third chamber having a variable volume comprising a compressible fluid under a pressure greater than atmospheric, said compressible fluid urging the club head into an non-rotatable position on said pivot shaft, and said compressible fluid pressurizing said incompressible fluid.

6. A club head having an adjustable loft angle as recited in claim 5, said toothed means for preventing rotation of the club head about said pivot shaft comprising axially aligned splines.

7. A club head having an adjustable loft angle as recited in claim 5, said third chamber comprising a piston slideably mounted within the club head.

8. A club head having an adjustable loft angle as recited in claim 5, said third chamber isolated from said second chamber by a flexible diaphragm.

9. A club head having an adjustable loft angle as recited in claim 5, said third chamber isolated from said second chamber by a flexible diaphragm wherein said flexible diaphragm is metallic.

10. A club head having an adjustable loft angle as recited in claim 5, said third chamber having a variable volume comprising a flexible fluid cell having a continuous surface.

11. A club head having an adjustable loft angle as recited in claim 10, said fluid cell enclosing a sealed volume, said fluid cell comprising a permeable elastomeric, polymeric, or rubber surface material surrounded by said incompressible fluid, said sealed volume inflated with a compressible fluid to a value greater than atmospheric, said gaseous medium in said chambers comprising an inert, non-polar gas, said gaseous medium comprising a partial pressure of air substantially less than atmospheric, said surface material having characteristics of relatively low permeability with respect to said gas to resist diffusion of said gas from said sealed volume through said surface material, and of relatively high permeability with respect to air.

12. A club head having an adjustable loft angle as recited in claim 11, said gas comprising one of more of the gasses selected from the group consisting of perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane; 1,1,2-trichloro-1,2,2 trifluoroethane, chlorotrifluorethylene, bromotrifluoromethane, and monochlorotrifluoromethane, hexafluoroethane, sulfur hexafluoride, perfluoropropane, and perfluorobutane.

13. A club head having an adjustable loft angle as recited in claim 12, said compressible fluid contained within a flexible fluid cell, whereby bubbles of air contaminating said incompressible fluid, when in contact with said fluid cell tend to diffuse into said fluid cell and are thereby scavenged from said incompressible fluid.

14. A club head having an adjustable loft angle as recited in claim 10, said flexible fluid cell comprising a gas having a permeability through said fluid cell surface substantially less than that of either nitrogen or oxygen.

15. A club head having an adjustable loft angle as recited in claim 5, said compressible fluid comprising a gas.

16. A club head having an adjustable loft angle as recited in claim 15, said compressible fluid comprising one of more of the gasses selected from the group consisting of nitrogen, oxygen, argon, methane, ethane, propane, butane, fluoroform, neo-pentane, perfluoropentane, perfluorohexane, perfluoroheptane, octafluorocyclobutane, perfluorocyclobutane, hexafluoropropylene, tetrafluoromethane, monochloropentafluoroethane, 1,2-dichlorotetrafluoroethane; 1,1,2-trichloro-1,2,2 trifluoroethane, chlorotrifluorethylene, bromotrifluoromethane, and monochlorotrifluoromethane, hexafluoroethane, sulfur hexafluoride, perfluoropropane, and perfluorobutane.

17. A pivot cartridge in combination with a golf club head having an adjustable loft angle, comprising:

said pivot cartridge having a pivot shaft comprising an attachment extension, a first cylindrical bearing surface, a second cylindrical surface, and at least one toothed shaft segment therebetween;

said pivot cartridge having a bushing comprising a third cylindrical bearing surface and a inner surface for mounting to said second cylindrical surface;

said pivot cartridge having a pivot cylinder comprising a fourth cylindrical bearing surface slideably engaging said first shaft bearing surface, a fifth cylindrical bearing surface slideably engaging said third cylindrical bearing surface, and at least one toothed segment therebetween engageable with said at least one toothed shaft segment, wherein said pivot cylinder is axially moveable between a distal and a proximal end position relative to said attachment extension of said pivot shaft, wherein said toothed cylinder segment is disengaged with said toothed shaft segment in said proximal position and is engaged in said distal position, and wherein said pivot shaft is not removable from said pivot cylinder; and said head comprising a surface for impacting a golf ball, and a blind hole behind and substantially parallel to said surface, wherein said hole the pivot cartridge is inserted.

18. A pivot cartridge in combination with golf club head having an adjustable loft angle as recited in claim 17, further comprising:

said pivot cartridge having a first seal sealing between said first cylindrical bearing surface of said pivot shaft and said fourth cylindrical bearing surface of said pivot cylinder;

said pivot cartridge having a second seal sealing between said fifth cylindrical bearing surface and said third cylindrical bearing surface of said bushing; and said pivot cartridge having an incompressible fluid substantially filling all the voids of the internal volume bounded by the exterior surface of said pivot shaft, the interior surface of said pivot cylinder, and said first and second seals.

19. A pivot cartridge in combination with a golf club head having an adjustable loft angle as recited in claim 18, said incompressible fluid comprising a lubricating oil or grease.

20. A pivot cartridge for a club head having an adjustable loft angle, comprising:

a pivot shaft comprising an attachment extension, a first cylindrical bearing surface, a second cylindrical surface, and at least one toothed shaft segment therebetween;

a bushing having a third cylindrical bearing surface and a inner surface for mounting to said second cylindrical surface;

a pivot cylinder comprising a fourth cylindrical bearing surface slideably engaging said first shaft bearing surface, a fifth cylindrical bearing surface slideably engaging said third cylindrical bearing surface, and at least one toothed segment therebetween engageable with said at least one toothed shaft segment, wherein said pivot cylinder is axially moveable between a distal and a proximal end position relative to said attachment extension of said pivot shaft, and wherein said at least one toothed cylinder segment is disengaged with said at least one toothed shaft segment in said proximal position and is engaged in said distal position;

a first and second chambers within the club head containing a substantially incompressible fluid; and at least one restrictive conduit between said first and second chambers, whereby axial movement of said pivot cylinder along said pivot shaft forces fluid between said first and second chambers.

21. A pivot cartridge for a club head having an adjustable loft angle as recited in claim 20, said attachment extension comprising a hosel.

22. A pivot cartridge for a club head having an adjustable loft angle as recited in claim 20, said attachment extension comprising a splined shaft for attachment to a hosel.

23. A pivot cartridge for a club head having an adjustable loft angle as recited in claim 22, said attachment extension comprising a threaded shaft for fastening to a hosel.

24. A pivot cartridge for a club head having an adjustable loft angle as recited in claim 20, said incompressible fluid comprising a lubricating oil or grease.

25. A pivot cartridge for a club head having an adjustable loft angle as recited in claim 20, said restrictive fluid conduit comprising the clearance between said toothed cylinder segment and said toothed shaft segment.

26. A pivot cartridge for a club head having an adjustable loft angle as recited in claim 20, said attachment extension comprising a hosel adapted to receive a shaft.

27. A golf club head having an adjustable loft angle, comprising a surface for impacting a golf ball, and a blind hole behind and substantially parallel to said surface, wherein said hole a pivot cartridge as recited in claim 20 is inserted.

28. A golf club head having an adjustable loft angle as recited in claim 27, further comprising a handle shaft and a hosel connecting said handle shaft to the club head.

29. A golf club head with a loft angle adjustable by externally applied compressive and twisting forces, comprising: a club head having a surface for striking a golf ball, said club head pivotably mounted on a pivot shaft having an axis, said pivot shaft having a proximal end for mating to a hosel and a distal end extending into the club head, the club head having a first and a second axial end orientations on said pivot shaft, said first orientation distally oriented relative to said second orientation, said first orientation non-rotatable relative to said pivot shaft, said second orientation rotatable relative to said pivot shaft, said pivot shaft and the club head creating a first variable volume therebetween, said first variable volume substantially filled with an incompressible fluid, said club head comprising a second variable volume substantially filled with an incompressible fluid, at least one restrictive conduit for fluid communication between said first variable volume and said second variable volume whereby fluid in said first variable volume may be flowed by the externally applied compressive force into said second variable volume, while said restrictive conduit preventing substantial fluid flow while striking said golf ball.

30. A golf club head with a loft angle adjustable by externally applied compressive and twisting force as recited in claim 29 wherein, said incompressible fluid comprises a lubricating oil or grease.

31. A golf club having a face for striking a golf ball, comprising: a club head mounted on a shaft having an axis, a hosel connecting said shaft to a handle for swinging the golf club, a plurality of interconnected chambers within said club head, said chambers filled with an incompressible fluid wherein at least two of said plurality of interconnected chambers have volumes that vary with axial motion of said head on said shaft, whereby said incompressible fluid is driven from one of said interconnected chambers having a variable volume into another said interconnected chamber having a variable volume to produce an axially directed force resisting said axial motion.

32. A golf club having a face for striking a golf ball as recited in claim 31, said incompressible fluid comprising a lubricating oil or grease.

* * * * *